United States Patent [19]

Cordier et al.

[11] Patent Number: 4,867,848

[45] Date of Patent: Sep. 19, 1989

[54] PROCESS AND APPARATUS FOR PRODUCING MOULDED COKE IN A VERTICAL FURNACE WHICH IS AT LEAST PARTLY ELECTRICALLY HEATED

[75] Inventors: Jean A. G. Cordier, Saint-Saulve; Bernard E. A. Dussart; Pierre H. Rollot, both of Haulchin, all of France

[73] Assignee: Usinor Aciers, Puteaux, France

[21] Appl. No.: 59,872

[22] PCT Filed: Sep. 26, 1986

[86] PCT No.: PCT/FR86/00332

§ 371 Date: Jun. 15, 1987

§ 102(e) Date: Jun. 15, 1987

[87] PCT Pub. No.: WO87/02049

PCT Pub. Date: Apr. 9, 1987

[30] Foreign Application Priority Data

Sep. 26, 1985 [FR] France ..... 85 14291

[51] Int. Cl.[4] ..... C10B 19/00; C10B 53/08

[52] U.S. Cl. ..... 201/6; 201/19; 201/20; 201/29; 201/34; 201/39; 202/99; 202/215; 373/6; 373/122; 373/138

[58] Field of Search ..... 201/6, 19–21, 201/34, 39, 29; 202/95, 85, 91, 99, 121, 221, 215, 108, 109; 48/65; 373/6, 56–59, 120, 122, 138, 151; 422/199; 34/13, 169

[56] References Cited

U.S. PATENT DOCUMENTS

| | | | |
|---|---|---|---|
| 1,100,709 | 6/1914 | Brown | 373/115 |
| 1,671,673 | 5/1928 | Doerschuk et al. | 201/19 |
| 2,127,542 | 8/1938 | Stitzer | 201/19 |
| 4,140,583 | 2/1979 | Halligan et al. | 201/34 |
| 4,357,210 | 11/1982 | Aubry et al. | 202/85 |
| 4,412,841 | 11/1983 | Du Broff et al. | 201/19 |
| 4,472,245 | 9/1984 | Halm | 201/19 |
| 4,624,003 | 11/1986 | Eirich et al. | 201/19 |

FOREIGN PATENT DOCUMENTS

| | | | |
|---|---|---|---|
| 152532 | 3/1951 | Australia | 373/122 |
| 0098771 | 1/1984 | European Pat. Off. . | |
| 409341 | 8/1922 | Fed. Rep. of Germany . | |
| 550053 | 5/1932 | Fed. Rep. of Germany . | |
| 3223573 | 12/1983 | Fed. Rep. of Germany | 373/6 |
| 628128 | 10/1927 | France . | |
| 2529220 | 12/1984 | France . | |

OTHER PUBLICATIONS

Perry et al., Chemical Engineers' Handbook, Fourth Edition, pp. 25-41-25-43.

*Primary Examiner*—Joye Woodard

*Attorney, Agent, or Firm*—Cushman, Darby & Cushman

[57] ABSTRACT

An apparatus and process for producing coke in a vertical furnace having an upper part for preheating and devolitalizing raw ovoids of coal, an electrically heated median part for carbonizing and coking the ovoids and a lower part for partially cooling the coked ovoids by counter current flow of recycled product gases recovered from the upper part of the furnace. A cooling chamber is connected to the lower part of the furnace for further cooling the coked ovoids by countercurrent flow of a portion of the recycled product gases which are withdrawn after flowing through the partially cooled coked ovoids and introduced into the upper part of the furnace to prevent condensation of condensibles contained in the product gases. The median part of the furnace may be electrically heated by electrodes, induction coils or a combination of electrodes and induction coils.

20 Claims, 7 Drawing Sheets

FIG. 2B
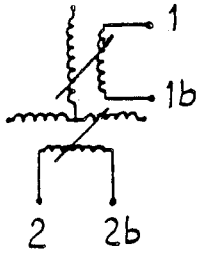
FIG. 2A
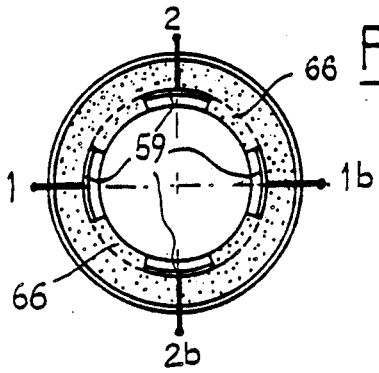
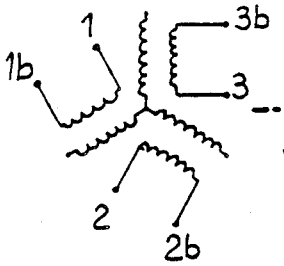
FIG. 3B
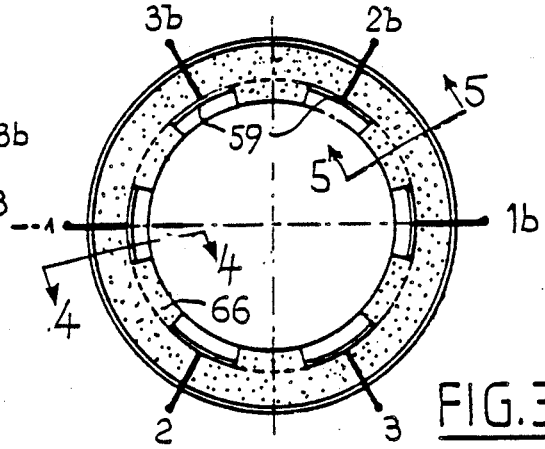
FIG. 3A
FIG. 4
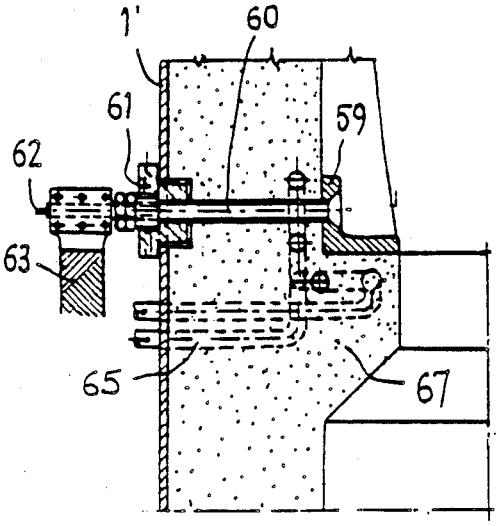
FIG. 5
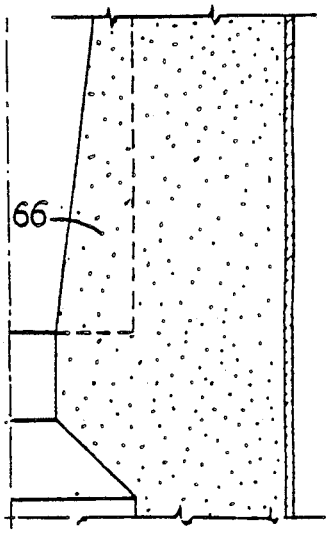

PROCESS AND APPARATUS FOR PRODUCING MOULDED COKE IN A VERTICAL FURNACE WHICH IS AT LEAST PARTLY ELECTRICALLY HEATED

BACKGROUND OF THE INVENTION

The invention relates to a process for manufacturing moulded coke and a vertical furnace for manufacturing said coke in which the heating and coking heat is provided by an electric supply of energy and transferred by a recycled current of gas. The invention also relates to an electrical heating process and device untilizing a fluid-conducting granulated bed.

Processes are known for manufacturing moulded coke in a vertical furnace in which a heap of moulded coal ovoids circulates downwardly in a counter-current manner relative to a recycled current of gas coming from a fraction of the gas produced by the coking and taken from the top of the furnace and re-introduced at the base of the latter.

The moulded ovods are coked in a median zone of the furnace by a gaseous supply from the distillation.

It has been proposed to achieve this supply of heat, initially produced by means of burners, by the dissipation of electrical energy by the Joule effect, which has for result to avoid the dilution of the coking gases recovered at the top of the furnace by the smoke resulting from the combustion, whose volume is large, in particular when the burners are supplied with air, and thus considerably increase the calorific value of the coking gases recovered at the top of the furnace.

In a first manner of tackling the problem, the calorific energy was supplied by an outer electrical heating, of the electrical resistance furnace type, however, this technique has a poor yield and efficiency, since the heap of coke is not uniformly heated. Indeed, the coke undergoes at the walls an excessive overheating which is excessively rapid and has an adverse effect on the mechanical behaviour of the ovoids (bursting and cracking) and on their metallurgical quality (re-activity).

Various publications, namely the patents FR-A-628,168, US-A-2,127,542, DE-A-409,341 and FR-A-2,529,220, have proposed for solving these problems, to supply the calorific coking energy directly in the concerned zone by supplying electrical energy to the heap of hot ovoids by generating electrical currents between diametrically opposed electrodes separated by the heap of ovoids to be coked.

In patent FR-A-2,529,220, the vertical furnace is in the form of a column having a cross-sectional shape which is substantially uniform throughout the inner height of the bed of moulded ovoids in circulation, and comprises, on one hand, electrodes disposed in a median zone of the lateral wall of the furnace, and, on the other hand, movable electrodes which are introduced through the upper part of the furnace into the bed of circulating ovoids and disposed in an adjustable manner at a level of the furnace higher than that of the fixed electrodes.

One of the major drawbacks of this type of furnace resides in the difficulty of ensuring an apropriate electrical conductivity of the bed of circulating moulded coal ovoids so as to regulate in a homogeneous and optimum manner the supply of heat required for the coking of the ovoids Indeed, the electrical conductivity of the mass of ovoids is related, partly, to the quality and the reproducibility of the individual contacts of the ovoids with one another, and therefore to the distribution of the internal pressures of this mass obtained by compacting. Now, an excessive local or general compacting of this bed constitutes a hindrance to the "fluid" flow of the materials and to a correct circulation of the bed, which is not acceptable.

Further, the passage of a localized current producing a localized heating by the Joule effect of the mass of ovoids considerably reduces the resistivity and results in a concentration of the electrical currents in a zone which is already excessively hot.

This difficulty is not suitably mastered by the means described hereinbefore and the regulation of the thermal equilibrium of the circulating ovoid bed is not ensured, which is however necessary for the control of the quality of the baking of the ovoids (namely progressive, regular, homogeneous and precise).

SUMMARY OF THE INVENTION

An object of the invention is to overcome these drawbacks by providing a process for manufacturing moulded coke in a vertical furnace whose structure optimizes the distribution of the supply of heating energy suitably distributed throughout the section of the furnace, while ensuring a correct circulation of the mass of coke and achieving optimum conditions of coking of the moulded coal ovoids.

The invention therefore provides a process for manufacturing moulded coke in a vertical furnace of the type comprising in its upper part sealed means for introducing a charge of raw moulded ovoids and means for recovering the gases produced; and, in its lower part, sealed means for discharging the coke and means for introducing a current of gas, which comprises circulating a current of recycled gases in an ascending flow counter-current to the descending charge of mouledd coal ovoids constituting a descending moving bed; subjecting the moulded coal ovoids to a pre-heating and de-volatilizing step in a first zone corresponding to the upper part of the furnace, then to a carbonizing and coking step in a second zone corresponding to a median part of the furnace, and to a step for cooling the coked ovoids in a third zone corresponding to the lower part of the furnace; recovering at the top of the furnace the top gases produced by the distillation and the coking of the coal ovoids; and recycling a fraction of said top gases so as to constitute the recycled gas current, characterised in that it comprises introducing a first part of the fraction of the top gases recycled at the base of the third zone so as to achieve a primary cooling of the coke and the rest of the fraction of the top gases recycled in the form of a secondary cooling current circulating counter-current to the mass of coke issuing from the third zone, in a fourth zone connected in a sealed manner to the outlet of the third zone, thereafter withdrawing the secondary cooling current from the fourth zone and re-introducing said secondary cooling current in the top of the furnace so as to dilute the gases produced and maintain the means for recovering said gases at a sufficiently high temperature to prevent any condensation; and a discharging the cold coke from the fourth zone through a sealed lock-chamber.

According to other features of the invention:

The terminal coking stage is carried out by dissipation of electrical energy by the Joule effect in the bed of ovoids which have become electrically conductive, until the desired final temperature is reached. The recycled gases, re-heated by thermal exchange in the final cooling of the ovoids are superheated on the ovoids which are electrically heated. They convey and transfer this heat in succession in the course of carbonization, distillation and pre-heating in the upper zones of the furnace.

The electrical heating is carried out by electrical resistance in the moving bed of coked moulded ovoids of a current generated between at least two diametrically opposed electrodes placed in the walls of the tank at the level of the second zone.

The electrical heating is achieved by induction of electrical currents in the moving bed of coked ovoids which fills the lower part of the second zone.

The invention also provides a process for manufacturing metallized moulded coke, characterized in that it comprises coking, by a process such as defined hereinbefore, a charge of moulded ovoids prepared by compacting a paste constituted by a single or mixed binder of a mixture of suitable coals, and fine particles of a material based on the metallic element to be incorporated in the coke, in the metallic or oxidized form.

The material based on the metallic element consists of oxides of iron, manganese ore and dust resulting from the production of ferro-manganese, concentrates of chromites for the production of ferro-chromium, quartz fines and silica powders which must be recycled for the production of ferro-silicon.

The invention also provides a vertical furnace for manufacturing moulded coke which is in the form of a substantially tubular enclosure defining a first pre-heating zone corresponding to the upper part of the enclosure, a second carbonizing and coking zone corresponding to the median zone of the enclosure, and a third coke cooling zone corresponding to the lower part of the enclosure, the furnace comprising at its top sealed means for introducing a charge constituted by raw moulded ovoids and means for recovering the gases produced, and, at its base, sealed means for discharging the coke and means for admitting a recycled gas current, the admission means being connected, outside the furnace, to means for recovering the gases produced by recycling means, and electrical heating means disposed in the wall of the second carbonizing and coking zone, characterised in that the furnace comprises a fourth sealed secondary cooling zone connected, upstream, to the discharging means of the third zone and, downstream, to a sealed discharging lock-chamber, the fourth zone comprising, at its base at least one conduit for supplyig a cooling secondary gas current connected to the recycling means, and, at its top, at least one return conduit for the secondary cooling gases connected to the upper part of the furnace in the vicinity of the means for recovering the gases produced by the distillation and coking of the coal.

The sealed means for introducing the charge comprise a sealed lock-chamber for supplying the charge and communicating in its lower part with the first zone of the furnace through a distribution bell, the supply lock-chamber being itself supplied by a rotatable hopper.

The means for discharging the coke issuing from the third zone comprise a rotating hearth which is movable in vertical translation and communicates, through a sealed lock-chamber, with the fourth secondary cooling zone.

According to a first embodiment of the invention, the electrical heating means are of the electrically resistive type and formed by at least one pair of diametrically opposed electrodes located at the base of the wall of the second zone of the enclosure of the furnace, said wall forming, in this zone, a constriction of the inner section of passage of the bed of moulded ovoids defined by a shoulder against which the fixed electrodes are mounted.

In a preferred embodiment of the invention, the electrodes comprise segments whose profile in vertical section is L-shaped extending along each side of the shoulder so that one of the branches of the L is horizontal.

In the case of a vertical furnace having a circular section, the electrode segments are circular and separated from the others by an interposed wall of a refractory and insulating material in the shape of an inclined plane corresponding to the slope of the shoulder defined by the L-shped profile of the electrodes.

This L-shaped profile is preferably chosen, since it results in an accumulation in the form of a heap of the coked and highly conductive ovoids on the electrode which they protect. This protective heap is constantly renewed. It prolongs the electrode while protecting it from abrasion of the descending moulded coke bed and it isolates the latter from the hot baking zone and from the gases of the recycled gas current which are very hot in this region. Consequently, there is a reduction in thermal losses and an improved mechanical resistance of the electrodes, above all when the latter are of cooled copper alloy.

According to a modification of the embodiment of the heating by resistance, the furnace comprises an inner enclosure having an ogival shape and made from a refractory material provided with a central electrode which cooperates with a peripheral electrode which circulates along the inner wall of the enclosure. The two electrodes are fed by a direct or a single phase current.

According to a second embodiment of the invention, the electrical heating means are of the induction type and formed by an induction coil coaxial with the tank and located in the refractory lining of the furnace.

In a modification, the furnace comprises an inner enclosure having an ogival shape and composed of a refractory material, in which is disposed a laminated magnetic core.

The good distribution of the heating energy is still further improved by winding around this magnetic core an internal induction core which is coaxial with the external induction coil and fed with current in phase with the latter by the same source of current at moderate frequency.

According to another modification, the induction heating means are formed by an assembly of pairs of induction coils disposed radially in the refractory wall of the furnace and defining an external inductor generating a rotating field extending horizontally across the tank.

According to a modification of this last-mentioned embodiment, adated to furnaces of large diameter, the furnace comprises an inner ogival-shaped enclosure made from a refractory material in which is disposed an internal inductor constituted by an assembly of radial coils disposed in facing relation to the coils of the external inductor and determining an assembly of pairs of coupled coils which cooperate for the generation of a rotating field between the external inductor and the internal inductor.

According to a further mixed embodiment, the electrical heating means are formed by the combination of at least one pair of electrodes such as described before, generating heat by electrical resistance and at least one coil gnerating heat by induction.

BRIEF DESCRIPTION OF THE DRAWINGS

The invention will be described hereinafter in detail with reference to the accompanying drawings which show several embodiments of the invention. In these drawings:

FIG. 2A is a horizontal sectional view taken on plane 2—2 of FIG. 1 of a first modification having two pairs of electrodes fed by a two phase current source (Scott transformer);

FIG. 2B is a diagram of the principle of operation of the feed of the electrodes of FIG. 2A;

FIG. 3A is a horizontal sectional view taken on plane 2—2 of FIG. 1 of a second modification having three pairs of electrodes fed by a triphase current source;

FIG. 3B is a diagram of the principle of operation of the feed of the electrodes of FIG. 3A;

FIG. 4 is a vertical radial sectional view taken on line 4—4 of FIG. 3A of the wall of the furnace in the zone of an electrode;

FIG. 5 is a radial and vertical sectional view taken on line 5—5 of FIG. 3A of the wall of the furnace;

DETAILED DESCRIPTION OF PREFERRED EMBODIMENTS

The process of the invention comprises coking in a continuous manner in a vertical furnace heated electrically by resistance and/or induction ovoids or balls of dried coal agglomerated by binders and press-moulded.

The pyrolysis of the ovoids in the furnace results in the emanation of gases of distillation of the coals and the binders, a large part of which is recycled to the base of the furnace after a rough purification. These recycled gases form an ascending gas current which cools the ovoids in the lower part of the furnace and progressively heats, in a counter-current manner, the ovoids which descend the upper part of the furnace.

The ovoids are successively pre-heated and dried and then the fumes are removed therefrom. The carbonization then ensures the mechanical consolidation of the ovoids The progressive heating of the ovoids completely eliminates the volatile substances at around 850° C. and the ovoids then become sufficiently conductive of electricity to function as electrical resistance heaters, when an electrical current is supplied to them. This resistivity is used for passing through the bed of ovoids electrical currents which heat the ovoids by the Joule effect within their mass and at the points of contact therebetween.

This electrical heating completes the baking and coking of the ovoids at the desired temperature.

The bed of ovoids then behaves in the manner of a heating grate which superheats in a counter-current manner the ascending gas current issuing from the lower part of the furnace in which the coked ovoids are cooled.

This superheating of the gas also has for effect to crack the heavy hydrocarbons still contained in the gas. The ascending gas current is thus mainly constituted of hydrogen (and methane). Owing to its particular thermal and electrical properties, it constitutes an excellent vehicle for exchange of heat between the gases and the ovoids, which avoids the formation of arcs and sparking between the ovoids.

The raw moulded ovoids or balls are prepared by first of all making up a paste of a mixed binder (resin, tar, asphalt ...) and the previously mixed, dried, crushed and pre-heated coals. The pre-heated paste is then compacted in the form of ovoids or balls in a press having tangential cylindrical hoops.

Figure 1:
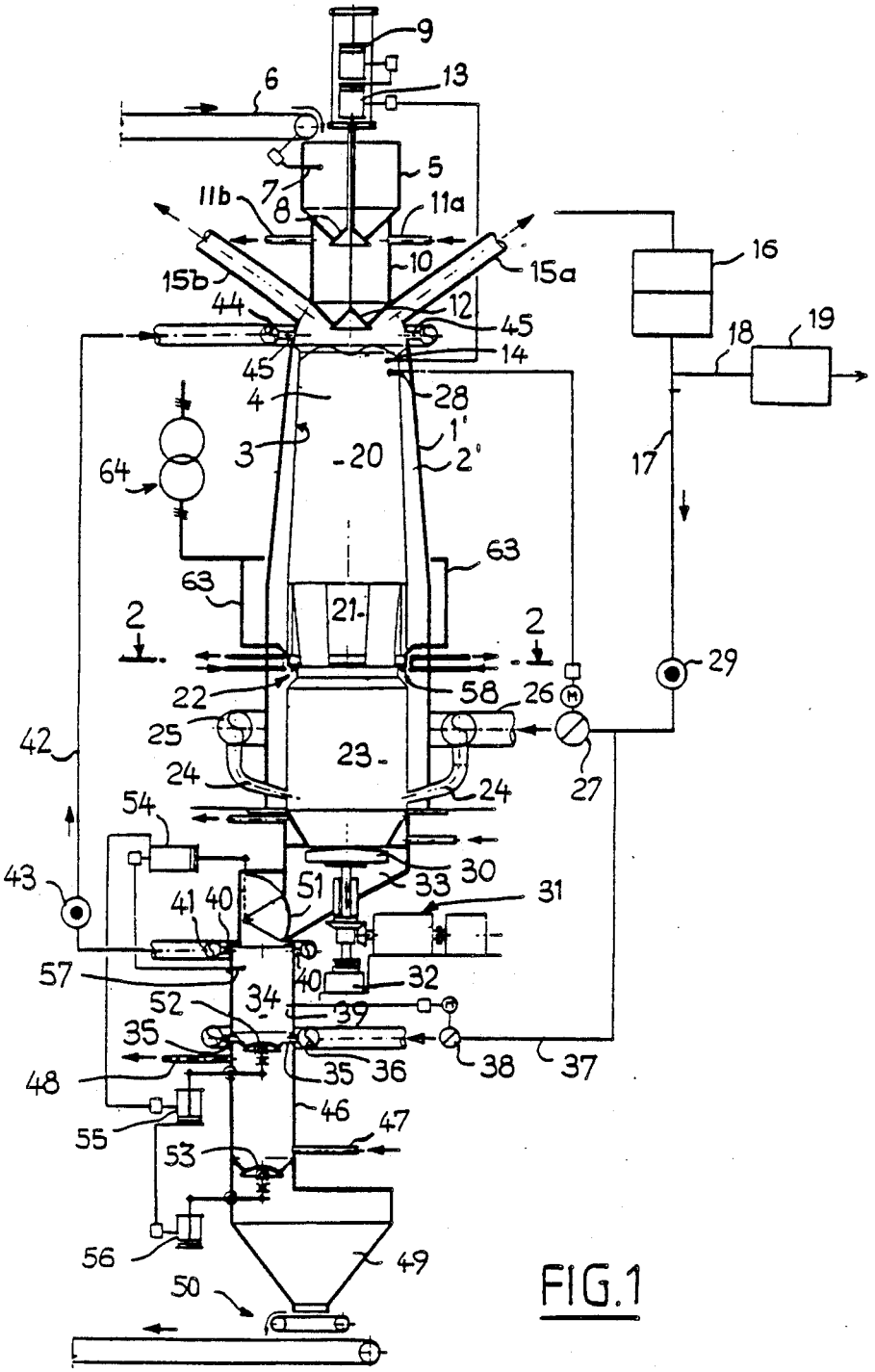
FIG. 1 is a diagrammatic axial sectional view of a vertical coking furnace according to the invention.
Figure 6:
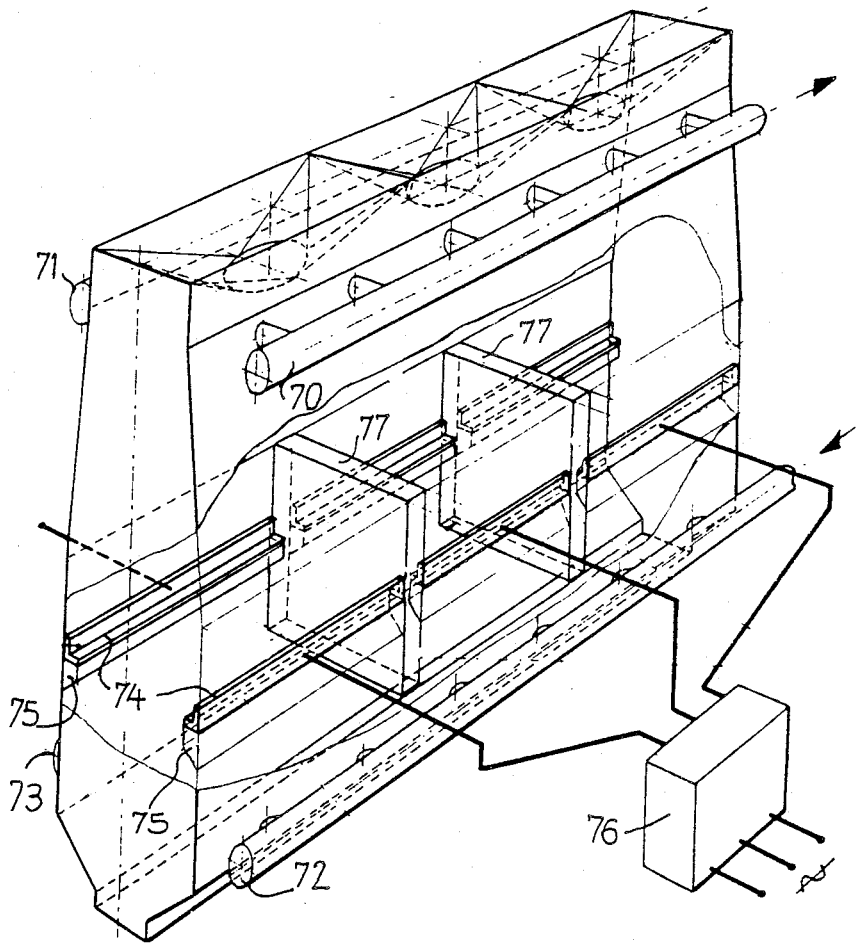
FIG. 6 is a perspective view of a battery of three coke furnace units according to the invention in a modification having a rectangular cross-sectional shape with three pairs of opposed electrodes fed with three phase current.

The vertical furnace shown in FIG. 1 comprises a metal shell or casing 1' provided on its inner surface with a refractory lining 2' defining a substantially tubular enclosure 3, which is slightly frustoconical in its upper part, in which there is charged a mass of moulded ovoids constituting the moving bed. In the embodiment shown in FIG. 1, the enclosure 3 has a circular section, but it may also have a rectangular section, as illustrated in FIG. 6.

The vertical furnace is charged at its upper end by sealed means for introducing the raw moulded ovoids which comprise a rotating hopper 5 fed with ovoids by a belt conveyor 6 controlled by a detector 7 of the level of the charge placed in the hopper. The hopper 5 includes in its lower part a rotating bell 8 the opening of which, under the control of a jack 9, causes the introduction of the ovoids into a sealed lock-chamber 10 comprising conduits **11*a*, 11*b* for purging by means of neutral gas. The sealed lock-chamber 10 is closed in its lower part opening into the furnace by a distribution bell 12 the opening of which is controlled by a jack 13 as a function of indications from a detector 14** of the level of the charge placed at the top of the vertical furnace.

The opening of the bells 12 and 8 is effected in sequence as a function of the indications of the detector 14.

The furnace is also provided at its upper end with means for recovering the gases produced which are constituted by two ducts 15*a*, 15*b* of large diameter opening into the enclosure of the furnace on each side of the rotating distributing bell 12.

The coking gas recovered by the ducts 15*a*, 15*b* is sent to a primary purifying installation diagrammatically represented at 16 so as to be subjected to a treatment including cooling, washing, removal of tar and a summary condensation of water and naphthalene. The gas treated in this way is recycled in respect of a fraction of 60 to 80% thereof to the furnace through recycling conduit 17 and sent in respect of the remaining fraction through the conduit 18 to a storage gasometer (not shown) through a conventional secondary purifying installation diagrammatically shown at 19.

The enclosure 3 of the furnace comprises three distinct operating zones. The upper part of the enclosure corresponds to a first baking zone 20 where the ovoids are gradually pre-heated and rendered smokeless by distillation of the coals and binders and undergo a first carbonization step by the ascending hot gas current flowing in a counter-current manner.

The median part corresponds to a second zone 21 of the end of the carbonization and coking at the base of which are installed the electrical heating means 22 disposed in the inner wall of the refractory lining 2'.

A third zone 23 for effecting a primary cooling of the coke formed occupies the lower part of the enclosure and includes at its base inlet means for a gas current recycled from the primary purifying installation 16. These means comprise a group of inlet conduits 24 for the primary recycled current issuing from a circular supply ring 25 connected to the recycling conduit 17 through a conduit 26 in which is mounted a valve 27 for regulating the flow and controlled as a function of the indications delivered by temperature detectors 28 located at the top of the furnace. The circulation of the recycled gas in the conduit 17 is ensured by a blower 29 and the inlet flow of a first part of the recycled gas, corresponding to a primary current, sent into the conduit 26, is regulated in such manner as to maintain the temperature detected by the detectors 28 at a predetermined set value, so as to avoid condensation of tars on the charged ovoids and on the inner walls of the furnace.

The furnace has at its base means for discharging the coke coming from the third zone 23, which comprise a rotating hearth 30 driven in rotation by a motor speed-reducer unit 31 and movable in vertical translation by means of a jack 32 for adjusting the height thereof.

The rotating hearth 30 puts the third zone 23 of the furnace in communication with a lock-chamber 33 which opens into a fourth zone 34 for effecting a secondary cooling of the coke.

The secondary cooling fourth zone 34 comprises at its base inlet conduits 35 for a secondary current for cooling corresponding to the remaining part of the recycled gas current. These conduits 35 extend from a circular ring 36 connected through a conduit 37 and a flow regulating valve 38 to the recycling conduit 17. The valve 38 is controlled in accordance with the indications delivered by a temperature detector 39 which measures the mean temperaure of the coke of the fourth zone 34 effecting the secondary cooling of the coke. The flow of the remaining part of the recycled gases introduced in the form of a secondary cooling current is regulated in such manner as to maintain the temperature of the coke detected by the detector 39 at a predetermined set value lower than the maximum temperature of the normal handling of the coke.

This secondary cooling fourth zone 34 comprises in its upper part conduits 40 opening into a circular manifold 41 of the secondary cooling current which is connected through a pipe 42, in which is mounted a blower 43, to a circular ring 44 for the return of the secondary cooling current surrounding the upper part of the furnace where there are recovered the gases produced which enter this circular ring 44 through return conduits 45.

The cooling fourth zone 34 is connected, on the downstream side, to sealed lock-chamber 46 provided with purging conduits 47, 48 and connected to a discharge hopper 49 which releases the cold coke onto an extracting and metering belt device 50.

The sequential and automatic opening of the valves 51, 52 and 53 ensuring the communication between the lock-chamber 33, the fourth zone 34 and the sealed lock-chamber 46, is controlled respectively by jacks 54, 55 ad 56 in accordance with the indications delivered by a detector 57 of the charge level located at the top of the fourth zone.

The structure of the furnace just described permits, by means of its device for recycling the gases divided into a primary current and a secondary current, on one hand, the optimization of the thermal profile of the furance in the carbonization zone by the regulation of the primary current, and, on the other hand, the avoidance of an accumulation of condensable tars in the upper part of the vertical furnace owing to the face that the temperature at the top of the furnace is maintained at at least 150° C. and to the entrainment of these tars by dilution in the secondary current extracted from the cooling fourth zone.

The ovoids or balls leaving the first zone reach a temperature of about 850° C., beyond which the electrical conductivity becomes appreciable and considerably increases to a limit value at about 1,100° C.

It is in the lower part of the secondary zone, where temperatures higher than 900° C. prevail, that the electrical currents are applied of induced which superheat the ovoids up to the final coking temperature, set at 950° to 1,250° C., depending on the reactivity of the coke that it is desired to produce (1,100° C. in respect of a metallurgical coke).

The coked ovoids descend in the lower part of the furnace corresponding to the third primary cooling zone 23, at the base of which is injected the recycled cold gas current which is used as a thermal transferring means in the various zones of the furnace.

After cooling, the coked ovoids extracted continuously from the third zone by means of a rotating hearth are discharged in two stages. In a fourth zone for effecting the secondary cooling of the coke, the ovoids are completely cooled by a recycled gas secondary current which is thereafter sent back to the top of the furnace; then they are removed from the furnace through the final lock-chamber purged with neutral gas, which eliminates any risk of explosion. The moulded coke is extracted in the cold state and then screened before expedition.

As compared with the coke produced in a battery of conventional furnaces, the manufacture of moulded electrical coke combines the advantages of coke baked by means of gas with those of the electrical process.

First of all, as compared with the conventional coke, the manufacture of the moulded coke has the following advantages:

Diversification of the supplies of coals and reduction in the cost price of the coke paste.

The process permits the massive use of anthracite, lean coals, inerts, coke dust, petroleum coke and the substitution of fusible melting coals by binders, such as resins, tars and asphaltic residues.

The decentralization of the production of the coke.

The process permits the production of moulded coke with smaller units adapted to the needs of quantity and quality (shapes, dimensions, baking temperature and reactivity of the coke).

The reduction in the investment costs of more than 20% for a given production.

A much higher thermal efficiency, since the top gases issue at about 150° C. and the ovoids are extracted in the cold state from the tank furnace while, in a conventional battery, the gases issue at 500° C., the coke is discharged from the furance at more than 1,000° C. and the smoke is at a temperature of more than 400° C. at the chimney.

An improved yield of the coke, since the dry cooling of the ovoids in the neutral gas does not oxidize the carbon of the coke as does the steam of the conventional wet extinction.

Further, as compared with moulded coke baked in a gas flame, the electric moulded coke has the following advantages:

The production of a rich distillation gas without heavy hydrocarbons, since the gas is not diluted in the combustion smoke and the recycling causes the cracking of the hydrocarbons. This gas can be valorized as furnace fuel or for extracting the hydrogen it contains.

An excellent yield of coke due to the absence of any combustion and/or surface oxidation of the ovoids in the furnace.

The control of the physical and chemical quality of the coke.

The combination of the electrical heating and the reycled gas counter-current results in a progressive coking with a precise control of the temperature of the various zones:smoke removal and pre-baking, carbonization and electric coking, cooling of the ovoids.

The homogeneity of the baking temperature ensures the regularity of the quality of the coke.

The control of the baking temperature permits the mastering of the reactivity of the coke produced:reactive coke for electrometallurgy (baked at low temperature), foundry coke with a very low reactivity (baked at high temperature: 1,300° C.), blast-furnace coke having an adjusted reactivity.

The choice of the size of the coke.

The supply of electrical energy to the coking front in each ovoid permits a progressive internal baking in the high temperature zone. It is possible to produce cokes having a larger size which are homogeneous and are more suitable for the blast-furnace or the cupola, since their strength is distinctly better than that of ovoids baked with gas.

The low inertia of the furnace.

The rapid electrical control of the heating permits adaptation to changes in the coking rate, the corrections the malfunctions (baking) and facilitates starting up and stopping.

The absence of pollution and improved working conditions.

The extraction of the ovoids is effected in the dry state. The furance is sealed when charging and discharging the furance. The pollution of the atmosphere is therefore limited and the working conditions are consequently considerably improved.

The possibility of employing small and medium size units.

The small units produce on the site the desired quantity and quality of the coke and may be economic since they may be automated and are not heavily penalized by a higher investment.

The heating means 22 disposed in the lower part of the second zone 21 correspond to two embodiments which will now be described.

According to a first embodiment corrsponding to an electrical heating of the resistance type, the inner wall of the refractory lining 2' defining the enclosure 3 forms a narrowing of the internal section of the passage of the bed of moulded ovoids to the lower part of the second zone 21. This narrowing is defined by a shoulder 58 formed along the wall of the enclosure 3.

As is in particular shown in FIG. 4, electrodes 59 having a profile in vertical section in the shape of an L extend along each side of the shoulder 58 so that one of the branches of the L is horizontal. The electrode 59 is of an electrically conductive material, for example copper, and fixed by a rod 60 extending therethrough and the refractory lining 2', to the exterior of the half-shell 1' by conventional means such as a nut and a lock-nut. The rod 60 is electrically insulated from the shell 1' by interposition of an electrically insulating material in the form of discs 61. The end of the rod 60 outside the shell forms a terminal 62 to which is fixed an electrical supply 63 for the electrode connected to the source of current 64 shown in FIG. 1.

The refractory lining zone 2' immediately adjacent to the electrode 59 is cooled by a tube 65 having an internal circulation of cooling fluid disposed as a coil along the two sides of the electrode 59 in front of the refractory lining. The electrode may also be cooled directly by the internal circulation of the cooling fluid. In the case of a vertical furnace having a circular transverse cross-sectional shape shown in FIGS. 2A and 3A, the electrodes 59 are in the form of diametrically opposed circular segments separated from each other by an interposed separating wall 66 which can be more clearly seen in FIG. 5. This wall 66 is in the shape of an inclined plane having an inclination corresponding to the slope of the shoulder 58 against which the electrodes 59 are mounted.

According to a first modification of the first embodiment using a supply at the frequency of the mains, there is disposed around the tank a pair of elecrodes 59 per phase. The electrodes of a given phase are diametrically opposed in the tank, as shown in FIGS. 2A and 3A, so as to ensure the passage of the current to the centre of the furnace. Their supply voltage is adjustable (phase by phase) by acting on the secondary winding of the supply transformer.

According to the dimension of the furnace, there is place for disposing the necessary two or three pairs of electrodes on the periphery of the furnace.

For furances of small diameter, for example less than or equal to 2 m, a two phase supply is provided such as that illustrated in FIGS. 2A and 2B by means of a Scott transformer in accordance with the connection diagram of FIG. 2A, which transforms a three phase primary supply into a two phase secondary supply (phases carrying the references 1 and 1*b*, on one hand, and 2 and 2*b*, on the other) of adjustable voltage.

In the case of furnaces of larger diameter, for example 3 to 4 m, illustrated in FIGS. 3A and 3B, the three pairs of electrodes carrying the references 1, 1*b*; 2, 2*b*; 3, 3*b* are supplied with power in accordance with the three phase diagram of FIG. 3B.

The electrodes 59 constituted by circular segments the section of which is in the shape of an L, bear inside the furnace on a cooled refractory ledge 67 (FIG. 4). There forms on each of these electrodes a natural heap of highly graphitized ovoids (by localized supercoking brought about by the prolonged stay of the ovoids at high temperature) which are very conductive and protect the electrodes 59 and distribute the current densities in the ascending charge.

Each electrode is separated from the neighbouring electrode by an insulating refractory interposed wall 66 which resists abrasion (for example silicon carbide bricks with a silicon nitride binder) the taper of which results in a slight progressive compression of the charge in the region of the copper electrodes so as to improve the homogenize the electrical conductivity of the bed of ovoids in the course of coking.

On the other hand, under the compressed coking zone, at the entrance of the primary cooling zone 23, the diameter of the furnace rapidly increases so as to reduce the compression of the bed of ovoids, increase the electrical contact resistances between the ovoids and avoid parasitic currents in the cooling zone where they would heat the already-coked ovoids at a shear lost. The developed width of the circular segments of the electrodes 59 is chosen to be approximately equal to the width of the interposed refractory walls 66 so as to avoid preferential passages between phases or even shorting from one phase to the other on the periphery of the furance.

The present invention has been described hereinbefore with reference to a furnace whose vertical chamber has a circular transverse cross-sectional shape. FIG. 6 shows a modification in which the cross-sectional shape of the tank is rectangular.

The structure of this furance is substantially similar to that described with referece to FIG. 1 as concerns the means for introducing the charge of raw moulded ovoids or balls and the recovery of the coke, and as concerns the recycling of the coking gas recovered through two collecting ducts 70 and 72 located at the top of the furnace and returned to the base of the primary cooling zone through two conduits 72 and 73. In this case also, the cooling of the coke occurs in two stages between which the fractions of the recycled gases are divided as previously explained.

As essential difference resides in the linear shape of the electrodes 74 for conducting electric current which are disposed on two opposed sides of the rectangular section and rest on ledges 75. These electrodes also have and L-shaped profile on which accumulates a heap of highly graphitized ovoids.

For an application of indusrial interest with a triphase supply, the furnaces are grouped in three units as shown in FIG. 6. Each current phase supplies power from a transformer 76 to a pair of copper electrodes. The electrodes of a given phase are disposed in facing relation to each other along each of the large sides of the furnace and are separated from the adjacent pair of electrodes by an insulating refractory wall 77.

Figure 8:
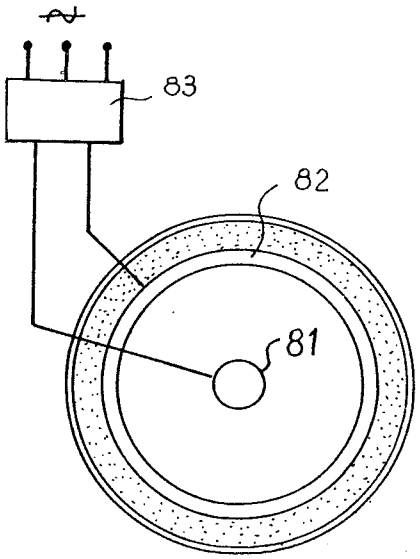
FIG. 8 is a horizontal sectional view taken on plane 8—8 of the furnace of FIG. 7.
Figure 7:
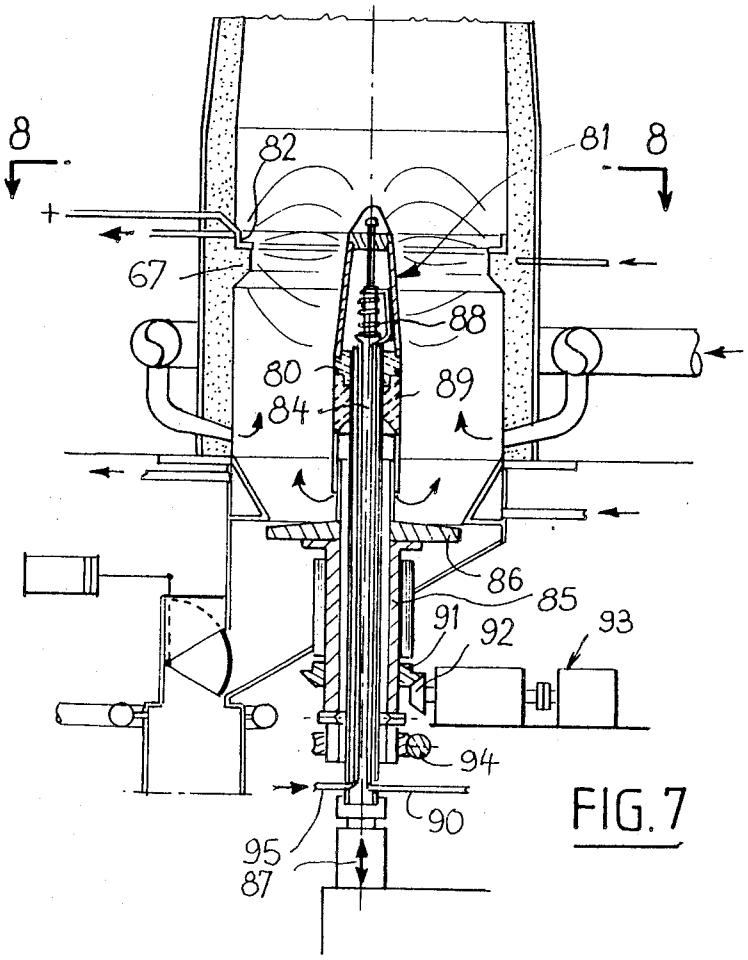
FIG. 7 is a partial axial sectional view of the lower part of a modification of the furnace of FIG. 1 with a single phase current supply or a dc supply.

In a modification of the first embodiment of the invention illustrated in FIGS. 7 and 8, the circular furnace comprises an inner enclosure 80 of ogival shape and made from are fractory material, whereas the structure of the enclosure 3 of the furance remains identical in all its peripheral parts. This enclosure 80 carries a central frustoconical electrode 81 which ensures the return of the currents passing through the mass of hot ovoids in process of coking and coming from a circular peripheral electrode 82 having an L-shaped section extending along the inner periphery of the tank above the ledge 67.

This arrangement is intended to avoid parasitic currents between the electrodes supplied by different phases and to ensure the passage of the current to the centre of the furnace. The supply is ensured, between the peripheral electrode 82 connected as an anode and the central electrode 81 forming a cathode, by a direct current source, for example a rectifier 83, or a single phase current source for a furnace of small capacity.

The ogival enclosure 80 is mounted on a rod 84 extending through the centre of a column 85 ensuring the support and the mobility of the annular rotating hearth 86.

In order to adjust the height of the electrical coking zone, the ogival enclosure 80 is vertically movable under the action of a jack 87 placed under the rod 84. In its upper part, the rod 84 is surmounted by an insulator 88 which prevents the passage of parasitic return currents along the rod 84.

The central electrode 81 in the shape of a truncated cone is made from a material which resists abrasion, such as densified silicon carbide which is sufficiently conductive of electricity to limit the localized heating of the walls of the cathode 81. The cathode 81 bears on a sleeve 89 of a refractory insulating material. The currents returning through the cathode 81 travel down to the base of the furnace through an insulated cooled conductor 90 disposed in an axial bore of the rod 84.

The column 85 is slidably mounted, for example by a system of splines (not shown), in a bevel gear wheel 91 for driving the column in rotation by means of a bevel gear pinion 92 engaged therewith, the pinion 92 being mounted on the end of an output shaft of a motor-speed reducer unit 93. The vertical sliding of the column is ensured by a jack 94. The rate of extraction of the coke, which is homogeneous throughout the periphery, is regulated by adjusting the speed of rotation of the metering hearth and the height of the latter.

The cathode 91 is cooled by a circulation of a cooled gas current from a conduit 95, this gas excaping through the annular gap provided between the ogival enclosure and the column 85 in the region where the enclosure 80 is placed over this column.

According to a second embodiment, illustrated in detail in FIGS. 9 to 13, the electrical heating is ensured by induction.

Figure 9:
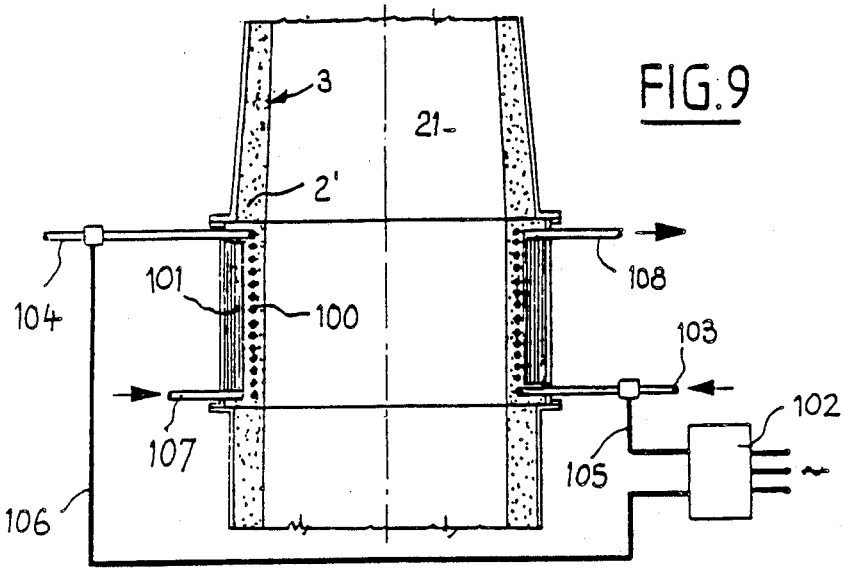
FIG. 9 is a diagrammatic partial vertical axisl sectional view of a second embodiment of the furnace according to the invention which is heated by simple induction.

As shown in FIG. 9, the heating means disposed at the base of the coking zone 21 comprise an induction coil 100 coaxial with the enclosure 3 and disposed in the refractory wall 2' of the furance. Mild steel cores 101, verticaly laminated, are disposed radially around the coil 100 and canalize the return lines of the field. The coil 100 is supplied with current by a generator 102 supplying a moderate frequency between about 50 and 1,000 Hertz.

The electric conductor which constitutes the coil 100 is a hollow tube in which circulates a cooling fluid introduced at 103 and drawn off at 104, which is itself connected by conductors 105 and 106 to the generator 102.

The laminated cores 101 constitute a magnetic yoke cooled by circulation of a cooling fluid introduced through the conduit 107 and drawn off through the conduit 108.

The expression of the voluminal power (dissipated electrical power multiplied by the unit volume of coke) established for the embodiment of FIG. 9, shows that the radius of the vertical chamber and the conductivity of the ovoids or balls have a determinant influence on the powers developed locally in the bed.

In particular, as the induction fields are weak at the centre of the furnace, this first embodiment has the drawback of unequally heating the balls which pass alongside the wall and those which pass alongside the centre of the furance which are liable to be insufficiently heated.

In the case of large-capacity furnaces (diameter of 3 m and more) in respect of which the ascending gas current would have a limited effectiveness in the reduction of the transverse heterogeneities in the heating, the beds of ovoids disposed adjacent the exterior would have a temperature and an electric conductivity substantially higher than the ovoids at the centre, which would result in different temperatures at the end of the coking, and an unequal quality of the coked ovoids at the centre and at the wall.

This simple solution shown in FIG. 9 is therefore limited to small coking units whose extracting device will favour a peripheral flow of the ovoids (for example, rotating hearth).

Figure 10:
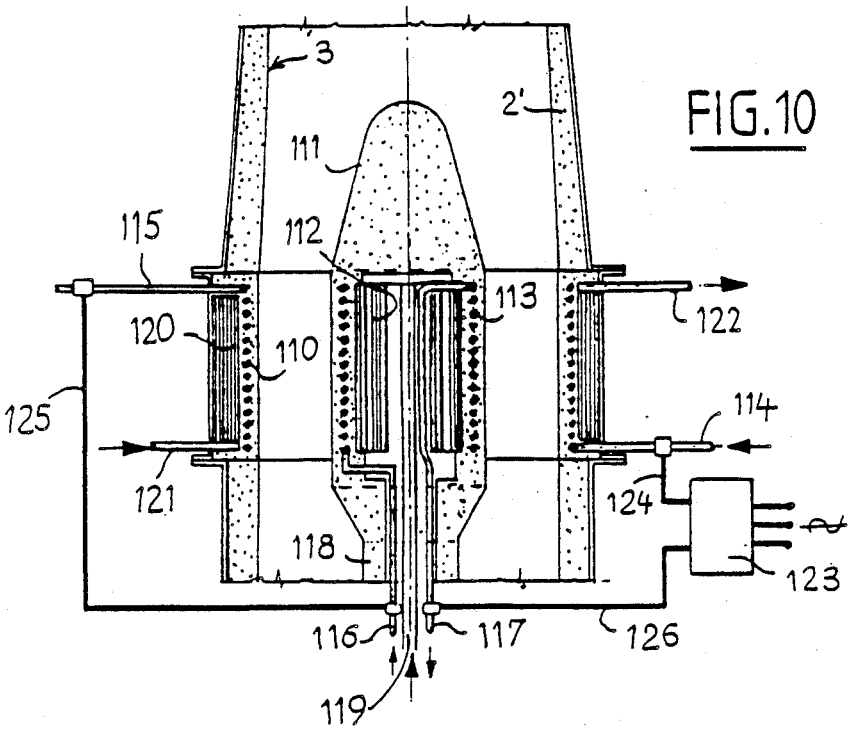
FIG. 10 is a diagrammatic partial vertical axial view of a second embodiment of the furnace of FIG. 9 with heating by exterior and axial induction.

According to a modification of the second embodiment illustrated in FIG. 10, the furnace comprises electrical induction heating means which further comprise an induction coil 110 coaxial with the enclosure 3 and disposed in the refractory wall 2' of the furnace, an inner enclosure 111 having an ogival shape and made from a refractory material which includes means for reinforcing the magnetic field in the vicinity of the axis of the furnace. The refractory material constituting the enclosure 111 may be, for example, silicon carbide with a binder of silicon nitride, whose properties of electrical insulation are sufficient for the envisaged application and whose resistance to abrasion and to thermal shocks is excellent.

These means may be formed by an assembly of vertically laminated mild steel cores 112 disposed radially and mounted in the ogival-shaped enclosure 111.

These means may be completed, as illustrated in FIG. 10, by an internal induction coil 113 coaxial with the coil 110, supplied in phase with the latter and located in the ogival-shaped enclosure 111. The vertically laminated mild steel cores 112 disposed radially are inserted in the coil 113 coaxially with the latter.

As in the case shown in FIG. 10, the induction coil 110 is formed by a hollow electric conductor wound helically and in which circulates a cooling fluid introduced at 114 and drawn off at 115. The internal induction coil 113 is made in the same way and cooled by the circulation of a cooling fluid between the inlet 116 and the outlet 117. This cooling circuit leads to the exterior of the furnace by circulation in a column 118 of a diameter smaller than the diameter of the ogival-shaped enclosure 111 and supporting the latter. The column 118 extends through the rotating hearth of the furance as illustrated in more detail in respect of the first embodiment of the induction heating represented in FIG. 7.

The assembly of laminated cores 113 constitutes an internal induction yoke also cooled by the circulation of a cooling fluid supplied by a central conduit 119 disposed along the axis of the column and leading to the top of the cores, the fluid being returned through a conduit which is coaxial with and outside and conduit 119.

Vertically laminated cores 120 are disposed radially outside the coil 110 and form an exterior induction yoke cooled by a circulation of a cooling fluid supplied through a conduit 121 and drawn off through a conduit 122.

A moderate frequency generator 123 supplies in series the coils 110 and 113 through a conductor 124 connected to the input of the coil 110, then a conductor 125 connecting the output of the coil 110 to the input of the coil 113 and a conductor 126 connecting the output of the coil 113 to the generator 123.

The coils 110 and 113 disposed in the furnace in facing relation to each other permit the association of their respective induction fields for simultaneously heating in a homogeneous manner the ovoids or balls passing along the peripheral walls of the enclosure 3 and the walls of the interior enclosure 111.

In yet another modification of the second embodiment, the induction heating means are constituted by a group of pairs of induction coils disposed radially in the refractory wall of the furnace and thus defining an external inductor generating a rotating field horizontally across the tank.

Figure 11:
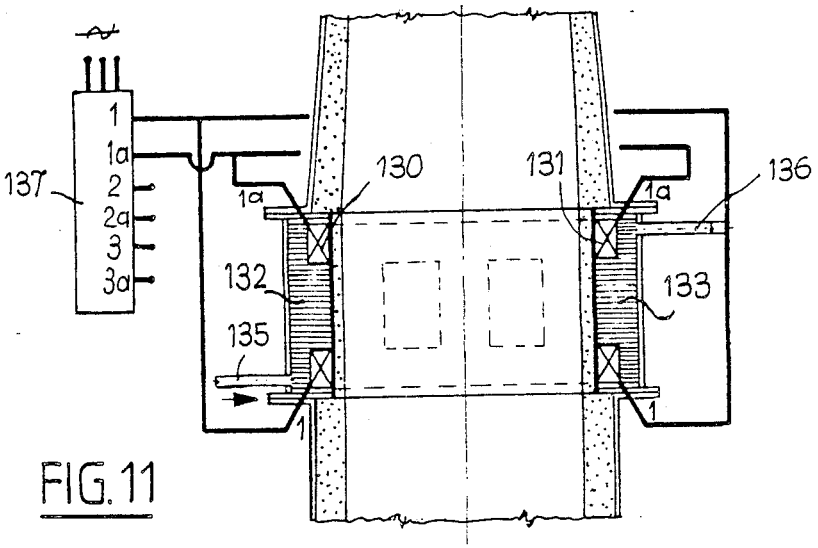
FIG. 11 is a diagrammatic pertial vertical axial sectional view of a third modification of the furnace of FIG. 9 with heating by exterior induction with rotating fields.
Figure 12:
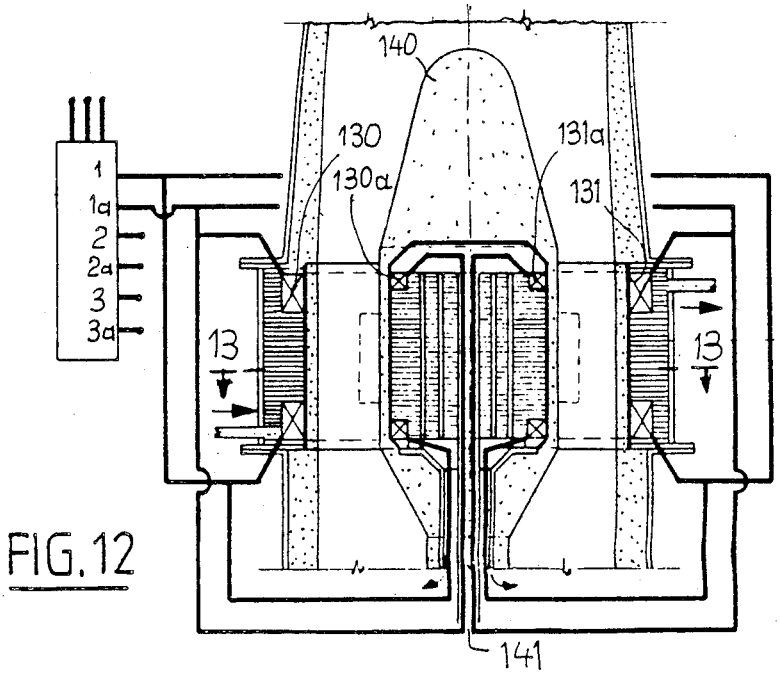
FIG. 12 is a diagrammatic partial vertical axial sectional view of a fourth modification of the furnace of FIG. 9 with heating by exterior and interior induction with rotating fields

In FIG. 11, two coils 130, 131 having their axes coincident and disposed radially and diametrically opposed, are wound on horizontally laminated magnetic steel cores forming inductors 132,133. The coils 130 and 131 are supplied by the same phase of a polyphase current having the reference numeral 1 so that the magnetic field radially crosses the tank, i.e. the confronting end faces of the coils 130, 131 are of opposite polarities.

In the normal case of a triphase current, three pairs of diametrically opposed coils are employed.

Each pair of coils 130, 131 which represents one phase is evenly offset in the inductor so that the resulting field rotates at the frequency of the supply currents and generates Foucault currents in the mass of coked ovoids or balls.

The inductors 132, 133 are cooled by the circulation of a cooling fluid supplied by a circuit entering through the conduit 135 and issuing through the conduit 136.

A medium frequency triphase generator 137 supplies the coils as shown in FIG. 11 in respect of two coils in an axial sectional plane.

Figure 13:
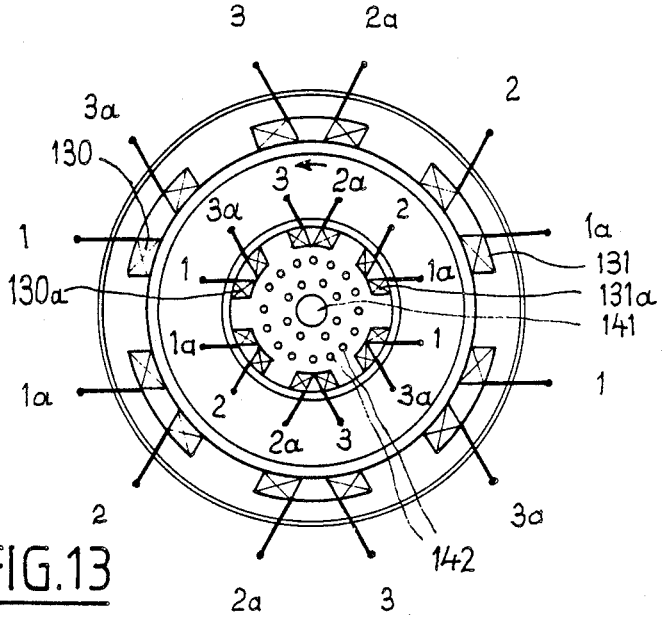
FIG. 13 is a diagrammatic horizontal sectional view taken on plane 13—13 of the furnace of FIG. 12 illustrating the principle of the connection of the inductors.

The horizontal section shows the supply which is arranged as indicated in FIG. 13 with reference to only the inductors outside the enclosure of the furnace.

According to yet another modification derived from that illustrated previously and shown in FIGS. 12 and 13, the furnace further comprises an interior enclosure 140 having an ogival shape and made from a refractory material in which is disposed an internal inductor constituted by a group of radial coils disposed in facing relation to the coils of the external inductor and determining a group of coupled pairs of coils which cooperate so as to generate a rotating field radially between the external inductor and the internal inductor.

Associated with a coil 130 of the external inductor is a coil **130*a* which is supplied in such manner that the confronting end faces of the coils have opposite polarities. Likewise, a coil 131***a* is associated with the coil 131.

The coils 130*a* and 131*a* are wound on a horizontally laminated magnetic steel inductor through which passes a cooling circuit constituted by central supply tube 141 and peripheral return tubes 142 (FIG. 13).

Figure 14:
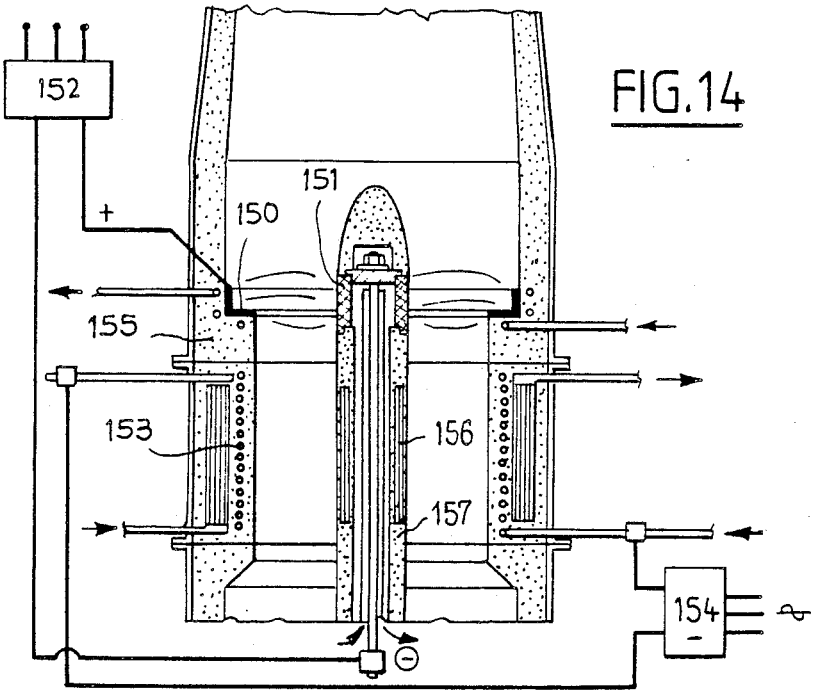
FIG. 14 is a diagrammatic partial view of a mixed embodiment of the invention with heating by single phase electrical resistance heating and exterior electromagnetic induction.

In a mixed modification shown in FIG. 14, the electrical heating means of the furnace comprise, in the coking zone, electrical resistance heating means with an L-shaped peripheral electrode 150 and a central electrode 151 such as those described with reference to FIG. 7 and supplied by a rectifier 152, and induction heating means comprising an axial coil 153, such as those described with reference to FIG. 9 and supplied by a medium frequency current source 154 and optionally a group of vertically laminated mild steel cores 156 disposed radially and located in the support column 157 of the electrode 151, such as those described with reference to FIG. 10.

The axial coil 153 is then disposed in the projecting ledge 155, on which bears the electrode 150, and below the latter.

This mixed arrangement combining an induction heating on the periphery of the tank combined with a resistance heating at the centre is intended for medium and large capacity furnaces. It associates:

an induction heating by a simple coil coaxial with the tank disposed in the refractory lining of the furnace; this coil, which is identical to the basic arrangement proposed for the induction heating of FIG. 9, ensures the heating of the external layers;

a resistance heating (by a single phase source or a direct current source) of the bed of ovoids between a central electrode and a circular electrode, such as described with reference to FIG. 7; this arrangement concerns the fluxes of current toward the electrode around which the ovoids are heated, since there is developed, in this region, by a decrease in the section, a greater current density and a greater voluminal power.

This associated of an induction coil with an electrical resistance heating between a central electrode and a peripheral electrode also permits a rapid rotation of the currents by action on these currents of the field lines created by the exterior coil.

In this way, the lines of current between the two electrodes are constantly renewed and the preferential passages of the current along the lines of ovoids which are the most conductive which result in localized overheating, are avoided.

The induction heating employs variable fluxes generated by induction coils completely outside the mass of ovoids being coked and avoids in large part the problems of variation in the resistance of contact between the ovoids and contact of the ovoids with the electrodes.

The effects of a plurality of coils may be associated in such manner as to control the induction flux lines in the electrical coking zone. These possibilities enable the heating currents to be uniformly distributed in the transverse section and to avoid the localized overheating of the ovoids close to the coils and the parasitic heating currents outside the baking zone.

Owing to these specific advantages, the electromagnetic induction developed in a bed of ovoids allows voluminal power levels which vary within wide limits. For an electrical gradient of 75 to 100 volts per meter, the developed power may reach 5 to 10 megawatts per cubic meter of hot and coked ovoids, whereas it is considerably lower by electrical resistance.

This electric power, higher than the sole thermal requirement of electrical coking, developed in the mass of ovoids, may be used for reducing, by the carbon of the coke and by the volatile substances of the binders, fines of ores or oxidized dusts which may be incorporated within composite ovoids or balls.

These reducing reactions, which are developed simultaneously with the electrical coking, regulate the electrical coking temperature of the ovoids and produce a very strong metallized coke.

The present invention encompasses a process for manuturing moulded coke whereby it is possible to add to the mixture of coals to be compacted into ovoids or balls:

Fines and dust of iron oxides (concentrated, steel work dust and blast-furnace gas, dust from installations for removing dust from agglomerations of ores, etc . . .).

Fines of manganese ores and dust of ferromanganese production.

Chromite concentrations for the production of ferrochromium.

Silica and quartz fines recycled in the production of ferro-silicon.

For these various applications, the amount of mineral fines incorporated in the coke paste is limited by the electrical conductivity of the bed of ovoids or balls which may not be lower than 100 mhos (electrical conductivity of the homogeneous medium equivalent to the bed of ovoids at the starting temperature of electrical coking, namely 850° C. to 900° C.).

The invention, as described hereinbefore, also relates to a process and device for dissipating in a uniform and homogegeneous manner large voluminal electric powers developped by the Joule effect of the induced electrical currents in a conductive granulated medium which may thus be brought to a high temperature.

This granulated bed has a large specific surface area and may be used for heating or superheating gases, liquids, or melting solids and vaporizing liquids by superheating the vapours thus produced.

The conductive granulated bed is constituted by sufficiently conductive refractory materials which are in calibrated pieces, particles, or solid or hollow and tubular cylindrical elements, rings, balls or pellets, or small bricks.

By way of examples, the refractory materials making up the conductive granulated bed may be constituted by calibrated pieces and particles of carbon, graphite, cokes, or by rings, pellets and cylinders of silicon carbide, molybdenium silicide, zirconium diboride, or by balls, pellets, small bricks of pastes of coal and cokable mixtures.

For the purpose of its utilization, the granulated bed is chosen as a function of its electric resistivity, its refractory quality, its specific surface area and its permeability, and lastly its resistance to oxidation and corrosion for the use to which it is put.

As examples of utilization there may be mentioned:

(a) heating of gases heating and superheating of reducing gases on a bed of calibrated coke pieces;

regeneration and generation of reducing gases by conversion into $H_2$ and CO of the $H_2O$ and $CO_2$ contained in the gas on a coke bed at 800° to 1000° C.;

cracking and oxidation of the heavy hydrocarbons contained in the raw and damp cokery gas on a coke bed at 900° to 1000° C. for producing in a single step the thermal "purification" of the raw and hot cokery gas by eliminating all the condensable products;

superheating to 1200° C. reducing gases intended for the "direct" reduction of iron oxides on a coke bed;

superheating to a high temperature of 1200° to 1350° C. of preheated air, optionally under pressure and superoxygenated as the wind of a blast-furnace on a bed of conductive tubular elements of silicon carbide or molybdenum silicide in the the form of rings.

(b) heating of conductive or insulating liquids, running over conductive granulated beds which are inert with respect to the liquid such as:

manufacture of dry superheated steam on a bed of cuttings or swarf of stainless and refractory steel;

superheating of liquid metal running over a bed of coke;

pasteurization of milk.

(c) Fusion of non-conductive solids, for example slags or glass-making "composition" on a "grill" of red coke. The viscous liquid running over the coke is heated and fluidized.

To carry out the process of preheating gas a furnace is used which comprises heating means such as those shown in FIG. 7 to 14.

The conductive granulated bed is compacted in a tubular enclosure of the furnace whose walls are lined with insulating refractory elements. This granulated bed rests on a refractory grill through which the gas to be superheated is blown. It may also be placed between two layers of nonconductive materials such as sand so as to center the escape lines.

We claim:

1. A process for manufacturing coke, comprising:

providing a vertical furnace having a tubular enclosure with an upper part, a median part and a lower part; the upper part including at an upper end a lock-type sealed charging inlet for raw ovoids of coal, an outlet for recovery of product gases, and an inlet for secondary recycled gas; the median part including a heater; and the lower part including at a lower end a lock-type sealed discharging outlet for coke, and an inlet for a first stream of primary recycled gas; a cooling chamber having an inlet at one end connected to said discharging outlet of said lower part of said vertical furnace, a lock-type sealed discharging outlet at an end opposite said one end for cold coke, an inlet at said opposite end for a second stream of primary recycled gas, and an outlet at said one end for secondary recycled gas; a first conduit connected to said outlet for recovery of product gases ad conducting off a portion thereof as a product; a second conduit by which said outlet for recovery of product gases is connected to said inlet for said first stream of primary recycled gas; a third conduit by which said outlet for recovery of product gases is connected to said inlet for said second stream of primary recycled gas; and a fourth conduit by which said outlet for secondary recycled gas is connected to said inlet for secondary recycled gas;

providing a supply of raw moulded ovoids of compacted coal and charging the ovoids into said upper part of said vertical furnace through said sealed charging inlet to provide a bed which descends through said furnace while operating said heater and circulating the first stream of primary recycled gas through said furnace countercurrent to said bed descending in said vertical furnace and preheating and devolatilizing the descending bed in a first zone corresponding to said upper part of said furnace, carbonizing and coking the descending bed in a second zone corresponding to said median part of said furnace, and cooling the descending bed in a third zone corresponding to said lower part of said furnace;

passing the descending bed out of said furnace into said cooling chamber as partially-cooled coked ovoids to provide a descending bed of partially-cooled coked ovoids therein while circulating the second stream of primary recycled gas through said cooling chamber countercurrent to said descending bed and further cooling the bed of partially-cooled coked ovoids in a fourth zone corresponding to said cooling chamber, and passing the coked ovoids out of said cooling chamber as cold coke, and withdrawing secondary recycled gas from the cooling chamber and introducing the withdrawn secondary recycled gas into the upper part of the furnace; and recovering product gases produced during devolatilization, carbonizing and coking of the bed of ovoids from the upper end of said upper part of said furnace while maintaining the product gases at a temperature which is sufficiently high to prevent condensation of tar, water and naphthalene contained therein by admixture with the secondary recycled gas.

2. The process of claim 1, including:

carbonizing and coking said bed in said second zone by applying electrical energy to said bed using said heater, thereby heating said bed and said gases flowing countercurrent to said bed in said second zone.

3. The process of claim 2, wherein:

said heater includes at least two separated electrodes, and electrical energy is applied to said bed by passing an electrical current between said electrodes via said bed and thereby resistively heating said bed.

4. The process of claim 1, wherein:

said heater induces an electric current in said bed and thereby inductively heats said bed.

5. The process of claim 2, wherein:

the step of providing a supply of raw, moulded ovoids of compacted coal comprises:

mixing together at least one binder, at least one coal, and a particulate substituent made of at least one metal or metal oxide to produce a paste; and compacting the paste into said ovoids.

6. The process of claim 5, wherein:

said particulate substitutent is selected from the group consisting of iron oxide, manganese ore, ferro-manganese, chromite, silica and quartz.

7. Apparatus for manufacturing coke, comprising:

a vertical furnace having a tubular enclosure with an upper part, a median part and a lower part; the upper part including at an upper end a lock-type sealed charging inlet for charging raw ovoids of coal into the upper part of said furance to provide a bed which descends through said furnace, an outlet for recovery of product gases, and an inlet for secondary recycled gas; the median part including an electrical heater; and the lower part including at a lower end a lock-type sealed discharging outlet for coke, and an inlet for a first stream of primary recycled gas; a cooling chamber having an inlet at one end connected to said discharging outlet of said lower part of said vertical furnace, a lock-type sealed dischargig outlet at an end opposite said one end for cold coke, an inlet at said opposite end for a second stream of primary recycled gas, and an outlet at said one end for secondary recycled gas; a first conduit connected to said outlet for recovery of product gases and conducting off a portion thereof as a product; a second conduit by which said outlet for recovery of product gases is connected to said inlet for said first stream of primary recycled gas; a third conduit by which said outlet for recovery of product gases is connected to said inlet for said second stream of primary recycled gas; and a fourth conduit by which said outlet for secondary recycled gas is connected to said inlet for secondary recycled gas

8. The apparatus of claim 7, wherein:

said lock-type sealed charging inlet for raw ovoids of coal includes a rotating hopper having an openable-closable distribution bell disposed in a lower part of said hopper.

9. The apparatus of claim 7, wherein:

said lock-type sealed discharging outlet for coke includes a sealed lock-compartment connected between said lower end of said lower part of said furnace and said inlet at said one end of said cooling chamber, and a rotatable hearth movable in vertical translation for opening and closing-off communication between said lower end of said lower part of said furnace and said inlet at said one end of said cooling chamber.

10. The apparatus of claim 7, wherein:

said tubular enclosure of said furnace includes peripheral wall means of refractory material in said median part, said wall means defining un upwardly facing shoulder means at which said tubular enclosure constricts in diameter; and said electrical heater includes at least one pair of transversally-opposed electrodes disposed on said shoulder means and being connected, outwardly through said tubular enclosure, to a means for supplying electrical power, whereby electrical energy may be applied to said bed by passing an electrical current between said electrodes via said bed and thereby resistively heat said bed.

11. The apparatus of claim 10, wherein:

each of said electrodes is L-shaped so as to have a generally horizontal leg and a generally vertical leg, each generally horizontal leg being disposed on said shoulder means and projecting radially inwardly from the respective said generally vertical leg, which projects upwardly adjacent said peripheral wall means, above said shoulder means.

12. The apparatus of claim 7, wherein:

said tubular enclosure of said furance includes peripheral wall means of refractory material in said median part, said wall means defining an upwardly facing shoulder means at which said tubular enclosure constricts in diameter; and said electrical heater includes:

a peripheral electrode disposed on said shoulder means and being connected, outwardly through said tubular enclosure, to a means for supplying electrical power, and a vertically extending central electrode connected outwardly through said furnace with said means for supplying electrical power;

an inner enclosure housing said central electrode which, together with an upper exposed portion of said central electrode, has an ogival shape in elevation, and said inner enclosure is comprised of a refractory material, whereby electrical energy may be applied to said bed by passing an electrical current between said electrodes via said bed and thereby resistively heat said bed.

13. The apparatus of claim 12 wherein:

said lock-type sealed discharging outlet for coke includes a sealed lock-compartment connected between said lower end of said lower part of said furance and said inlet at said one end of said cooling chamber, and having a rotatable hearth movable in vertical translation for opening and closing-off communication between said lower end of said lower part of said furance and said inlet at said one end of said cooling chamber;

said central electrode being mounted via said inner enclosure on said rotatable hearth for vertical translation therewith for adjusting said exposed portion of said central electrode in height relative to said peripheral electrode.

14. The apparatus of claim 10, wherein:

said tubular enclosure is of rectangular transverse cross-sectional shape.

15. The apparatus of claim 7, wherein:

said tubular enclosure of said furnace includes peripheral wall means of refractory material in said median part; and said electrical heater includes an external induction coil disposed in said refractory material so as to be coaxial with said tubular enclosure in said median part, said induction coil being connected with an external means for supplying electrical power for inducing an electromagnetic field said bed.

16. The apparatus of claim 15, wherein:

said electrical heater further includes an internal laminated magnetic core; and an internal induction coil would on said internal laminated magnetic core;

an inner enclosure housing said internal laminated magnetic core; said inner enclosure, together with said internal laminated magnetic core, having an ogival shape in elevation; said inner enclosure is comprised of a refractory material and said external induction coil and said internal induction coil being connected to said external means for supply electrical power and providing said coils with electrical power in phase with one another.

17. The apparatus of claim 7, wherein:

said tubular enclosure of said furnace includes peripheral wall means of refractory material in said median part; and said electrical heater includes a group of pairs of external radially-acting induction coils disposed in said refractory material, said external induction coils of each pair being diametrically opposed transversally of said tubular enclosure and said pairs being equiangularly spaced from one another angularly of said tubular enclosure, so that said group of pairs, collectively, are coaxial with said tubular enclosure in said median part, said pairs of induction coils being connected to respective phases of an external means for supplying polyphase electrical power for inducing an electrical magnetic field said bed which revolves angularly around said furnace.

18. The apparatus of claim 17, wherein:

said electrical heater further includes a group of pairs of internal, radially-acting induction coils, said internal induction coils of each pair being diametrically opposed transversally of said tubular enclosure and said pairs of internal induction coils being equiangularly spaced from one another angularly of said tubular enclosure, so that said group of pairs of internal induction coils, collectively are coaxial with and centrally located in said tubular enclosure in said median part, each pair of said internal induction coils being disposed in radially spaced confronting relation with a respective pair of said external induction coils;

an external means for supplying polyphase electrical current;

confronting pairs of said internal and external induction coils being connected with respective same phases of said external means for supplying polyphase electrical current, thereby providing a group of pairs of coupled coils which cooperate so as to generate a rotating field said bed; and an inner enclosure housing said internal induction coils; said inner enclosure, together with said internal induction coils, having an ogival shape in elevation; said inner enclosure is comprised of a refractory material.

19. The apparatus of claim 15, wherein:

said peripheral wall means defining an upwardly facing shoulder means at which said tubular enclosure constricts in diameter; said shoulder means being located above said external induction coil disposed in said wall means; and said electrical heater further comprises at least one pair of transversally-opposed electrodes disposed on said shoulder means and being connected, outwardly through said tubular enclosure, to a second external means for supplying electrical power, whereby electrical energy may be applied to said bed by passing an electrical current between said electrodes via said bed and thereby resistively heat said bed.

20. The apparatus of claim 17, wherein:

said electrical heater further includes a vertically extending central electrode connected outwardly through said tubular enclosure to said second external means for supplying electrical power; an inner enclosure housing said central electrode, which, together with an upper exposed portion of said central electrode, has an ogival shape in elevatin, and said inner enclosure is comprised of a refractory material, whereby electrical energy may be applied to said bed by passing an electrical current between said transversely - opposed electrodes and said central electrode via said bed and thereby resistivity heat said bed.

* * * * *